US006698168B1

(12) United States Patent
Terwilliger

(10) Patent No.: US 6,698,168 B1
(45) Date of Patent: Mar. 2, 2004

(54) FLEXIBLE HARNESS SADDLE TREE

(76) Inventor: Al G. Terwilliger, P.O. Box 215, Clawson, MI (US) 48017

( * ) Notice: Subject to any disclaimer, the term of this patent is extended or adjusted under 35 U.S.C. 154(b) by 29 days.

(21) Appl. No.: 10/331,203

(22) Filed: Dec. 30, 2002

(51) Int. Cl.[7] ..... B68B 1/00; B68C 1/02; B68C 1/12

(52) U.S. Cl. ..... 54/38.1; 54/39.1; 54/41.1; 54/2

(58) Field of Search ..... 54/38.1, 39.2, 54/41.1, 42.1, 2; D30/135

(56) References Cited

U.S. PATENT DOCUMENTS

| | | | | | |
|---|---|---|---|---|---|
| 580,616 | A | * | 4/1897 | Haspel | 54/41.1 |
| 595,400 | A | * | 12/1897 | Miller | 54/41.1 |
| 689,470 | A | * | 12/1901 | Duff | 54/38.1 |
| 1,105,287 | A | * | 7/1914 | Miller et al. | 54/38.1 |
| 1,146,562 | A | * | 7/1915 | Gilson | 54/41.1 |
| 1,328,922 | A | * | 1/1920 | Jardine et al. | 54/39.1 |
| 3,672,123 | A | * | 6/1972 | Dykman | 54/39.1 |
| 3,890,768 | A | * | 6/1975 | Gaines et al. | 54/39.1 |
| 4,414,790 | A | * | 11/1983 | Mitchell | 54/2 |
| 4,662,157 | A | * | 5/1987 | Frigon et al. | 54/2 |

* cited by examiner

*Primary Examiner*—Charles T. Jordan
*Assistant Examiner*—Elizabeth Shaw
(74) *Attorney, Agent, or Firm*—Harness, Dickey & Pierce, P.L.C.

(57) ABSTRACT

The tree of a harness saddle band is formed of an elongated, narrow, thin, strip of resilient plastic material bent into an inverted U-shape having a central bight portion and integral depending leg portions. The bight portion is stiffened to resist bending or flexing of the bight portion. The depending leg portions are resiliently flexible relative to the bight portion for independently bending laterally towards an away from each other and for independently bending longitudinally forwardly and rearwardly of the horse. The junctions between the leg portions and the bight portion are provided with raised ribs which are decreasingly tapered in the direction from the bight portion towards the free ends of the leg portions. Thus, the saddle band may resiliently flex or bend with the lateral expansion and contraction of the horses body during breathing of the horse and may resiliently flex or bend longitudinally with the corresponding longitudinal movements of the portions of the horse's body which are overlapped by the harness saddle band.

19 Claims, 4 Drawing Sheets

FLEXIBLE HARNESS SADDLE TREE

BACKGROUND OF THE INVENTION

This invention relates to an improved saddle tree which forms a part of the upper band portion of a harness saddle of the type used for trotter and pacer horses who pull carts.

The conventional harness used for attaching a sulky or cart to a trotter or pacer horse, in general, comprises a narrow band which encircles the horse's body, rearwardly of the neck and forelegs. Typically, such a band is formed of an upper, inverted U-shaped part and a lower, generally U-shaped, girth strap part. The two parts are connected together to form the complete, roughly circular, band shape. The shafts or poles of the sulky, which are located on opposite sides of the horse and extend longitudinally of the horse, are connected to the upper part by suitable hitches. In addition, the reins, over-check strap and other straps that are utilized are connected or engaged with the upper part of the band.

The harness construction is essentially the same for either trotters or pacers. The essential differences between a trotter and a pacer horse relate to the gaits of the horses. In the case of a trotter, one foreleg and an opposite rear leg of the horse move forwardly and rearwardly together. For example, the left foreleg and the right rear leg move forwardly and rearwardly simultaneously. In the case of a pacer, the horse's foreleg and rear leg on the same side of the horse move forwardly and rearwardly at the same time. For example, the left foreleg and left rear leg would move forwardly and rearwardly during the running of the horse. The shafts of the sulky or cart, upon which the driver of the horse sits, are essentially the same in construction and are located on opposite sides of the horse.

The harness upper band part in the past included a harness tree which is an inverted U-shaped member that fits over and around the back and side portions of the horse. The harness tree, typically is covered on its upper and lower surfaces by suitable padding or strips of leather or plastic. In the past, such trees were formed of wood and more recently, have been formed of narrow, thin strips of metal. Thus, the tree, when arranged between covering flexible strips of leather or other padding, provides stiffness or substantial rigidity to the upper band part. However, the band upper part normally has some limited flexibility in the lateral direction, but substantially no flexibility in the longitudinal direction.

When a horse runs, the horse's body expands and contracts laterally during heavier than normal breathing. In addition, the opposite sides of the horse move in the horses longitudinal direction relative to each other as the horse's legs move forwardly and rearwardly. Thus, prior stiff or relatively rigid trees cause the harness band upper part to rub longitudinally and to chaff the sides and upper back portions of the horse. This is due to the relative longitudinal forward and rearward movements of the sides of the horse's body and the static, non-movement of the upper band portion of the harness. This action causes discomfort to the horse, particularly when running any substantial distances during training or during races.

The present invention is concerned with an improvement to the harness by constructing a harness tree which resiliently flexes laterally inwardly and outwardly and whose opposite sides resiliently flex longitudinally forwardly and rearwardly in response to the movements of the horse's body during heavy breathing and during leg movements when running.

SUMMARY OF THE INVENTION

This invention contemplates forming the harness tree, which is encased between upper and lower covering strips to form a composite harness upper band part, in a shape and of material, which enables the tree to resiliently flex laterally inwardly and outwardly of the horse's body, and longitudinally, in the forward and rearward direction of the horse, to conform to the movements of the portions of the horse's body which the upper band part overlaps.

The tree is formed of a thin, narrow, resilient plastic material which is of an inverted U-shape. Thus, the tree, encased between the upper and lower strips of the upper harness band, covers the horse's back and the upper portions of the horse's sides.

As the horse breaths inwardly and outwardly so that its body expands and contracts during breathing, particularly heavy breathing, the downwardly extending legs of the U-shaped tree resiliently flex towards and away from each other in accordance with the expansion and contraction movements of the side portions of the horse's body which are overlapped by the tree. Simultaneously, as the horse's opposite sides move longitudinally forwardly and rearwardly, relative to each other, the depending legs of the U-shaped tree independently resiliently flex forwardly and rearwardly with the moving side portions of the horse that the legs overlap. Hence, the moving upper band portion of the harness avoids or substantially reduces rubbing or chaffing the horse's body. This construction, provides a harness which flexibly and resiliently moves with the horse's overlapped body portions rather than remaining substantially stationary relative to the overlapped body portions.

An object of this invention is to provide a harness tree which is encased within the upper portion of the band forming a harness saddle, and which is formed of a material and is of a shape to resiliently flex inwardly and outwardly and forwardly and rearwardly of the horse in response to the movements of the horse's body to thereby cause the harness to similarly flex so that the harness and the horse's body are substantially stationary or immovable relative to each other.

A further object of this invention is to form a flexible harness tree which resists corrosion or deterioration that frequently occurs in prior saddle trees, particularly those formed of strips of metal.

Still a further object of this invention is to provide a harness particularly suited for trotter and pacer horses pulling a sulky or cart, which harness is comfortable to the horse during heavy breathing and longitudinal movements of the sides of the horse during running.

Still a further object of this invention is to provide a harness which is durable and resists damage due to the environment in which the harness is used.

An additional object of this invention is to provide a harness formed for serving as an anchor or connection point for an overcheck strap, which passes over the horse's head and neck to help maintain the horse's head high during running, without imposing an unnecessary or uncomfortable strain upon the horse.

These and other objects and advantages will become apparent upon reading the following description of which the attached drawings for a part.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

The following description is intended to show a preferred embodiment of this invention and is exemplary in nature and not intended to limit this invention.

Figure 1:
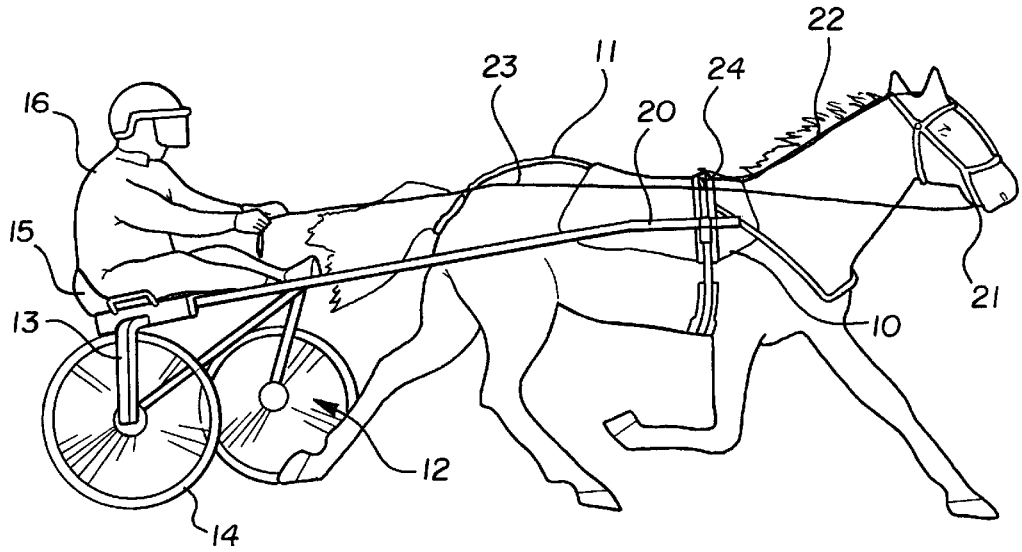
FIG. 1 schematically illustrates a trotter horse pulling a sulky or cart and shows the location and use of the harness saddle of this invention.

Referring to the drawings, FIG. 1 schematically illustrates a harness saddle 10 positioned upon a horse 11. The horse is indicated as being in the trotting position. However, the drawing is also intended to represent pacer horses or horses performing any other gait.

The horse is shown to be pulling a sulky or cart 12. The cart, which is conventional, comprises a frame 13 with wheels 14 secured to the frame and a seat 15 upon which the driver 16 sits. The sulky includes a pair of forwardly extending shafts or poles 20 which are positioned on the opposite sides of the horse. The horse has a conventional bridle 21 and a conventional overcheck strap 22 extending from the bridle rearwardly of the horse to the harness saddle. The elongated reins 23 which extend from the bridle to the driver, pass through loops 24 or terrets which are secured on the saddle 10. The shafts or poles 20 are connected to the saddle by conventional shaft hitches 25. The hitches, loops or terrets, bridle and the sulky may vary depending upon the particular model or type used at any particular time. These items form no part of the present invention. Those skilled in the art would normally select the particular equipment they choose to use.

Figure 2:
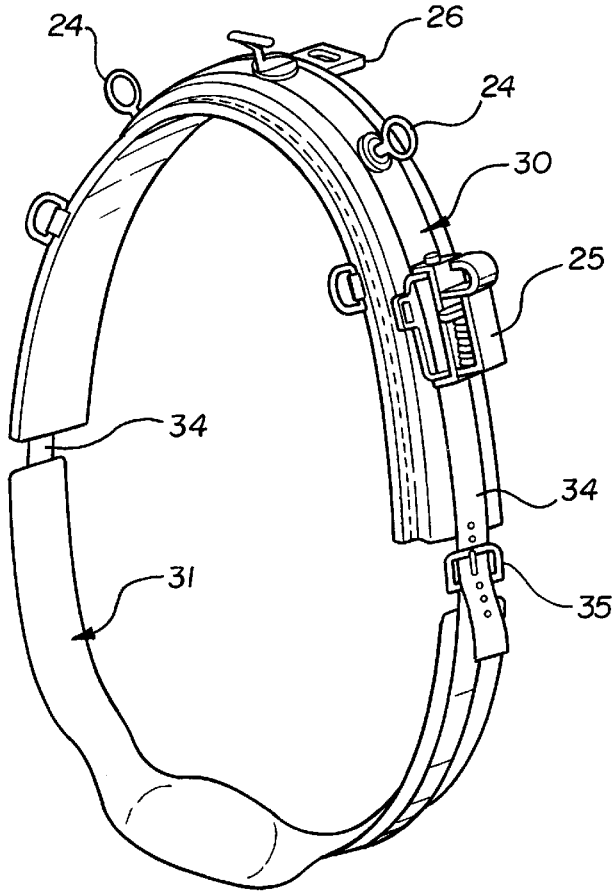
FIG. 2 is a perspective, schematic view of the harness saddle.

The harness saddle 10, in general, forms a circular band that extends around the horse's body rearwardly of the base of the neck and rearwardly of the forelegs, as schematically shown in FIG. 1. The saddle includes an upper band part 30, in the form of an inverted U-shape. The saddle has a lower band part 31 or girth, which is connected to the upper band part by means of billet straps 34 and suitable buckles 35. (See FIG. 2). When the saddle is placed upon the horse, encircling the horse's body from the upper surface of the horse around the belly of the horse, the straps are suitably tightened by their buckles to hold the harness saddle in its use position.

The harness saddle upper band part 30 comprises, as its main parts, a saddle tree 40 which is sandwiched between an upper cover 41 and a lower padding strip 42 which together form the saddle upper band part 30. The upper cover strip 41 may be made of a suitable flexible plastic or leather material. The lower padding strip 42 may be made of a plastic or leather material which is suitably padded for providing more comfort to the horse. The saddle tree 40 is preferably formed of a suitable, flexible, resilient plastic material. The shape and operation of the saddle tree 40, in general, is the focus of the invention herein.

Prior harness saddles, as mentioned, had saddle trees made of wood or a metal strip or combinations of elongated curved metal strips whose free ends have short plastic strips riveted thereto. The plastic strips form short extensions of the ends of the central metal strip. The conventional, prior saddle trees are generally stiff in the longitudinal direction, but some permit inward and outward lateral flexing. However, with conventional constructions, the harness saddles put considerable side pressure on the horses during heavy breathing when the horses' sides expand and contract quickly. In addition, conventional saddles tend to rub or scuff the sides of the horses as the horses' sides move forwardly and rearwardly relative to each other when the horses are running. The present saddle tree 40, is formed of a flexible, resilient, relatively thin and narrow band of a plastic material which permits lateral, inwardly and outwardly directed, resilient, flexibility of the legs of the inverted U-shaped saddle. In addition, the legs of the inverted U-shaped saddle tree may resiliently flex forwardly and rearwardly, relative to each other, in the longitudinal directions of the horse. Thus, the saddle band moves with the movement of the horse's body so that the band and the horse's body are relatively stationary. That avoids the scuffing, rubbing or inwardly directed pressure previously associated with prior harness saddles.

The particular plastic chosen to form the saddle tree may be selected from commercially available plastics by those skilled in the art of plastic molding. The selected plastic material should be durable, flexible and be sufficiently resilient to flex during use as well as to resist the relatively harsh environments in which a harness saddle is used. That is, the plastic material should be capable of resisting cracking or breaking due to the repeated flexing laterally and longitudinally. Prior metal trees, typically formed of a narrow, thin, steel strip, tend to crack or break or to rust or otherwise deteriorate under the conditions of repeated flexing and ambient cold and hot weather conditions, and tend to accumulate moisture from sweat or rain.

The saddle tree herein is formed so that its upper central part or bight portion 44, as will be described below, is generally relatively rigid or non-bendable, while the depending legs 45 tend to flex in the lateral and the longitudinal directions.

The saddle tree center portion 44 may be thickened or reinforced so that it is stiffer or less flexible than the integral legs 45 joined thereto. Thus, the bight or center portion 44 may be thicker than the legs 45 which are integral with and extend from the center portion. The exterior surfaces of the legs 45 are provided with outwardly bulged portions 46 that form flat channels. The leg inner surfaces, adjacent the center portion, are provided with inwardly extending, tapered comb-like rib formations 47. These formations include a transverse base rib 48 extending transversely of the tree band. Tapered finger-like ribs 49 extend longitudinally from the base rib to form a comb-like formation. In addition, cross ribs 50 are formed across the comb-like finger formation. This formation provides a variable flexibility for the legs 45 in the general area where they join the center portion 44 of the tree. The taper of the ribs 49 provides for less flexibility near the center portion of the tree and provides increasingly more flexibility of the rib portions that are more distant from the tree center portion.

Figure 3:
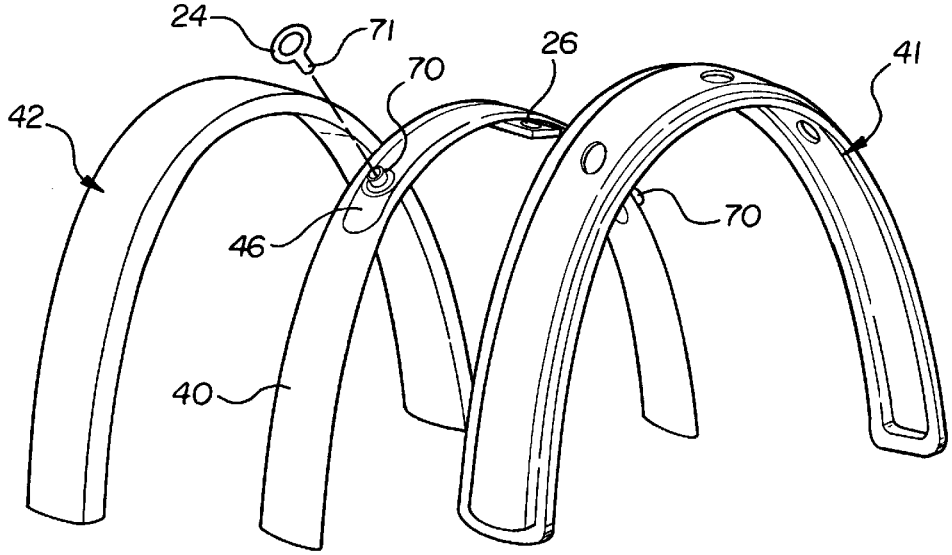
FIG. 3 shows, in perspective, the three major elements forming the upper part of the harness saddle in disassembled relationship.
Figure 4:
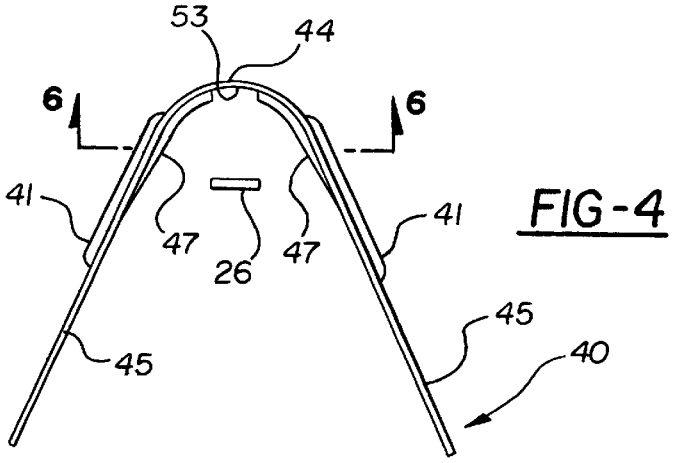
FIG. 4 is a reduced scale, end view of the saddle tree.
Figure 5:
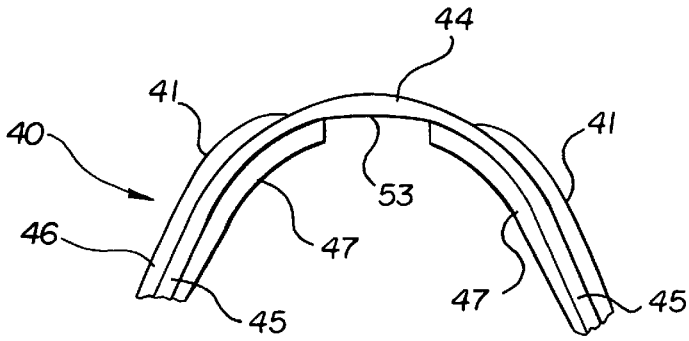
FIG. 5 is an enlarged, fragmentary, end view of the upper portion of the saddle tree.
Figure 6:
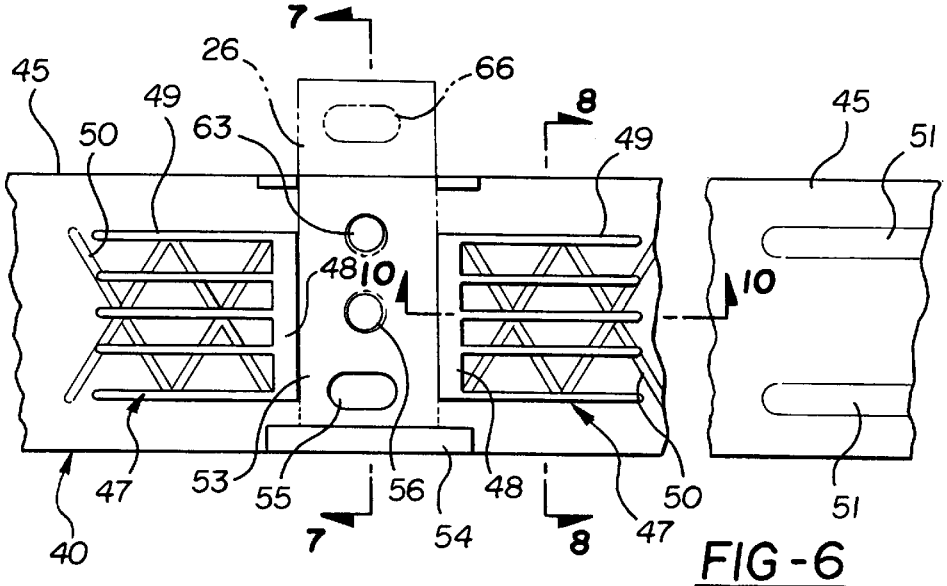
FIG. 6 is an enlarged, fragmentary view of the lower surface of the central area of the saddle tree taken in the direction of arrows 6—6 of the FIG. 4, with the center plate, illustrated in dashed lines, positioned on the central area of the tree.
Figure 7:
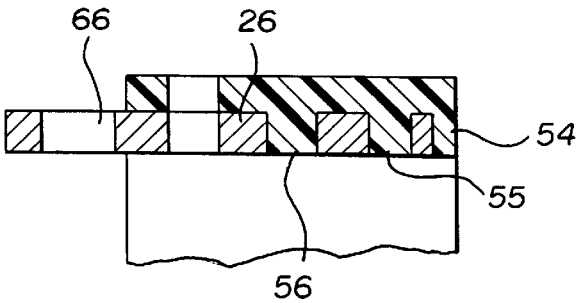
FIG. 7 is an enlarged, fragmentary view showing, in cross-section, a portion of the saddle tree with the view taken in the direction of arrows 7—7 of FIG. 6.
Figure 8:
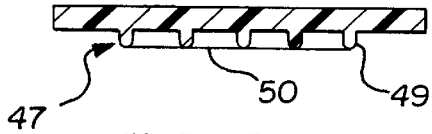
FIG. 8 is an enlarged, cross-sectional view of a portion of the saddle tree taken in direction of arrows 8—8 of FIG. 6.
Figure 11:
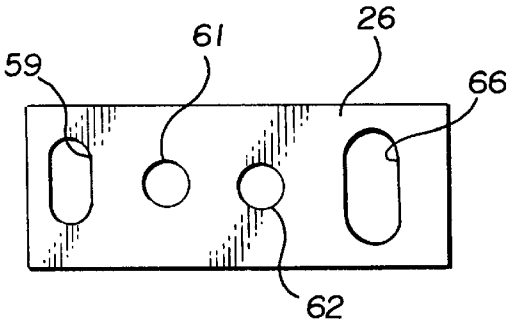
FIG. 11 is a view of the center plate which provides the anchor for the overcheck strap or any other portions of the harness strapping and, simultaneously serves to stiffen the center of the tree.
Figure 10:
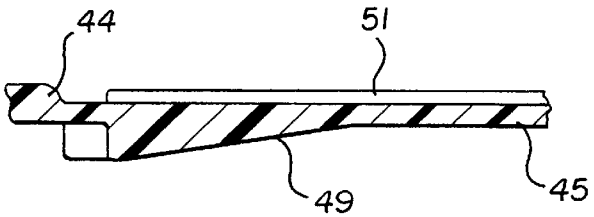
FIG. 10 is a cross-sectional, schematic view taken in the direction of arrows 10—10 to illustrate the tapered fingers formed on the legs.

Elongated beads 51 are formed on the inner surfaces tree legs and extend in a generally elongated U-shape, as illustrated in FIG. 3, along the length of the legs. A center seat 53 is provided at the center portion 44 of the tree (see FIG. 6) to receive a metal plate 26 which serves as an anchor for connecting the conventional overcheck strap and adjustable back strap for the crupper. Simultaneously, the plate 26 stiffens the center portion 44 of the tree. The seat area 53 includes an integral stop 54 to engage and position the plate 26. A boss 55 near the stop is formed in the seat area. Another boss 56 is formed in the middle of the seat. These bosses fit within corresponding openings formed in the plate 26. Thus, the plate, see FIG. 11, includes an opening 59 to receive the boss 55 and a second opening 61 to receive the boss 56. The plate may also have an opening 62 to overlie an opening 63 formed in the seat and an elongated, transversely arranged slot 66 for providing an anchor point for the back strap of the crupper.

Sockets or bushings 70 are mounted in the legs of the tree for receiving a mounting spindle portion 71 of the terrets 24 (see FIG. 3). Thus, a provision is made for the mounting of the terrets through which the reins may pass.

The comb-like, tapered finger configuration may be formed of a solid inwardly extending unitary, wedge shaped configuration or alternatively may be formed with separated tapered fingers, to provide gradual changes in flexibility of the legs near the upper, center portion of the tree.

Figure 9:
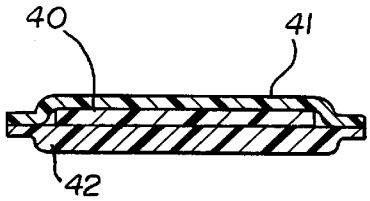
FIG. 9 is a fragmentary, cross-sectional schematic view showing the saddle tree sandwiched between an upper cover strip and a lower padding strip.

When the tree is arranged between the upper and lower covering strips 41 and 42, it is sandwiched between the strips by sealing the edges of the upper and lower strips together. If the strips are formed of a thin plastic material, a heat seal can be used join them together to encapsulate the tree 40 between them (see FIG. 9). Alternatively, if the strips are made of leather or of leather-like plastic sheet material, the edges of the upper and lower strips may be stitched or riveted together along their adjacent edges to encapsulate the tree between the strips. Thus, the assembled upper band portion of the harness saddle provides a sturdy construction that is flexible and resilient The amount of resiliency depends upon the resiliency of the plastic material that is utilized in forming the tree as well as the tapered configurations where the legs join the center portion.

Figure 12:
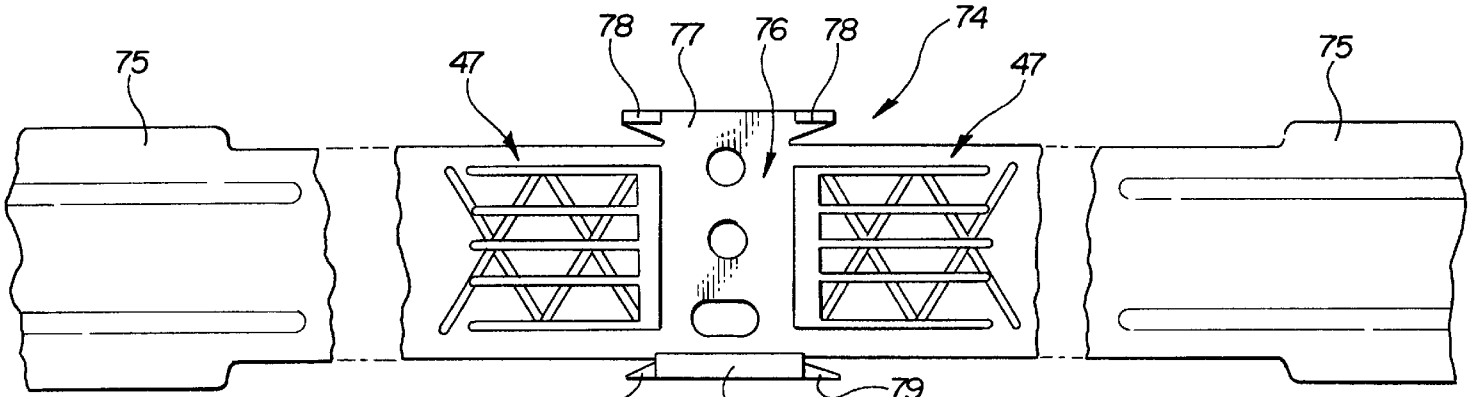
FIG. 12 is an enlarged, fragmentary view of the lower surface, of a modified central portion formed on the tree.

FIG. 12 illustrates a modified tree having a narrowed central bight portion 74. The opposite leg portions 75 resiliently flex relative to the bight portion. However, the tapered comb-like finger or rib formation 47 provides a variable flexibility at the opposite ends of the narrowed central portion. The seat 76, formed at the center of the bight portion may also be provided with an extension 77 at one edge along with the stop 54 at its opposite edge. The extension may be formed with edge projections 78 and the stop 54 may be provided with edge projections 79 which help position the tree relative to its upper and lower cover strips (not shown).

This invention may be further developed within the scope of the following claims. Having fully described an operative, preferred modification or embodiment of this invention, I now claim:

What is claimed is:

1. A flexible harness saddle tree for positioning, as a part of a harness saddle which encircles the body of a horse, over the back and sides of a horse comprising;

an elongated, substantially flat, thin, narrow band of a resiliently flexible material bent into an inverted U-shape to form a pair of downwardly extending leg portions that are integrally joined together at their upper ends by a central bight portion;

said bight portion being rigidified against flexing and said leg portions being flexibly and resiliently moveable relative to the bight portion for independently resiliently flexing towards each other in a lateral direction relative to the tree and being independently flexible for resiliently moving longitudinally relative to the axis of the U-shape of the tree;

whereby the tree may be positioned over the back and sides of a horse as part of a harness saddle band portion which is located upon the back and sides of a horse, so that said harness saddle portion may resiliently flex laterally along with the saddle tree leg portions towards and away from the body of the horse and may flex longitudinally, relative to the length of the horse, in response to lateral and longitudinal movements of the portions of the horse's body upon which the harness saddle is positioned.

2. A flexible harness saddle tree as defined in claim 1, and including a rigid plate portion formed on the center of said bight portion for stiffening the bight portion against flexing movement, with said leg portions being each resiliently moveable relative to said central portion.

3. A flexible harness saddle tree as defined in claim 2, and including each of the leg portions at the junction between the leg portions and the bight portion having an integral thickened portion which decreasingly tapers in cross section from the junctions of their respective legs and the bight portions towards the free ends of the legs.

4. A flexible harness saddle tree as defined in claim 3, and including said tree being formed of a resiliently flexible plastic material and having an inner and outer surface; and said surfaces being covered by a flexible plastic band which encase the tree so that together the bands and the encased tree form the upper portion of a harness shaped to encircle the body of a horse.

5. A saddle tree for a harness as defined in claim 1, and with the junctures of the leg portions and the bight portion being formed with thick portions that are decreasingly tapered in cross-sectional thickness from the bight portion towards the free ends of the legs for providing variable flexibility of the legs relative to the bight portion at the upper ends of the legs where they join the bight portion.

6. A harness saddle tree as defined in claim 5, and with said thickened portions being in the shape of spaced apart ribs extending from a surface of the legs, with the ribs being tapered in height so as to vary the thickness, at the ribs, of the juncture portion where the legs join the bight portion.

7. A flexible harness saddle tree as defined in claim 5, and with each of the thickened portions comprising at least one elongated rib extending along a portion of the strip from the bight portion along the adjacent part of the leg portion and with each rib being generally tapered in depth relative to the surface of the strip for providing a variable flexibility of the leg relative to the bight, that is, greater flexibility in the thinner, as compared to the thicker tapered portions of the ribs.

8. A flexible harness saddle tree as defined in claim 1, and including said tree being formed of a plastic material characterized as being resiliently flexible and resiliently returnable to original shape so that the tree leg portions independently flex and resiliently return to their initial shape and size in accordance with the movement of the portions of the horse's body which are overlapped by the tree.

9. A flexible harness saddle tree as defined in claim 1, and including a stiff metal plate positioned upon the bight portion of the tree at the upper center thereof for stiffening the bight portion against flexing.

10. A flexible harness saddle tree as defined in claim 1, including said thickened portions comprising a series of generally parallel, spaced apart, elongated, narrow ribs integrally extending in the longitudinal direction along the leg portions from the central bight portion towards the ends of the respective leg portions, and with the ribs each being tapered in depth relative to said surface.

11. A flexible horse's saddle tree as defined in claim 10, and said ribs being formed upon the inner surface of the band, that is, the surface adapted to be closely adjacent to the surface of the horse's body.

12. A flexible harness saddle tree as defined in claim 1, including a substantially flat, stiff metal plate positioned upon the bight portion of the tree for stiffening said portion against flexing, and with a pair of raised, transversely extending rib portions formed integral with the strip and extending transversely of the strip and arranged at opposite transverse sides of the plate for positioning the plate relative to the strip.

13. A flexible harness saddle tree as defined in claim 12, and including a series of tapered ribs formed on a surface of the legs and extending longitudinally from the bight portion along the leg portions, with said ribs being tapered in depth from deeper to shallower in the direction from the bight portions towards the ends of the leg portions.

14. A flexible harness saddle tree as defined in claim 13, and with the bight portions of the tree being of a narrower width than the legs, and said ribs being arranged within the narrow bight portion.

15. A flexible harness saddle tree as defined in claim 13, and including a raised stop portion formed at the central bight portion for engaging and positioning one end of the metal plate upon the bight portion, with the metal plate having an attachment engaging portion extending transversely outward of the strip bight portion to which a strap of the horse's harness may be connected.

16. A flexible saddle tree for the upper portion of a harness saddle for positioning around the body of a horse, comprising;

an elongated, substantially flat, thin, narrow strip formed of a resiliently flexible material that is bent into an inverted U-shape to form a pair of downwardly extending leg portions that are integrally joined together at their upper ends by a central bight portion;

said bight portion being stiffened to resist bending or flexing of the bight portion;

said leg portions forming integral junctures with the bight portion and being resiliently flexible at said junctures;

whereby the leg portions may resiliently flex towards and away from each other in response to breathing movement of the horse's body and may resiliently flex forwardly and rearwardly, that is, longitudinally of the horse in response to corresponding movements of the portions of the horse's body which are overlapped by the tree.

17. In a flexible harness saddle formed of a band sized to fit around the back and side of the body of a horse rearwardly of the horse's neck, for connecting harness straps and the shafts of a sulky or cart or the like to the horse, with the band having an upper band portion which is generally in the shape of an inverted U-shape for positioning over the back of the horse and overlapping portions of the sides of the horse, and with a saddle tree arranged as part of the band, overlapping the horse's back and portions of the sides of the horse's body adjacent the horse's back, the improvement comprising said saddle tree being in an inverted U-shape and formed of a resiliently flexible strip made of a plastic material and which band is substantially flat, thin, and narrow and formed with a central bight portion and integral depending leg portions;

said bight portion being relatively stiffer than the leg portions and the leg portions being flexible at the areas where they join the bight portion;

said leg portions being resiliently flexible towards and away from each other and being independently flexible longitudinally relative to the central bight portion;

whereby the legs may resilient bend, and the band which is formed by the legs, may resiliently bend independently of each other in response to the expanding and contracting breathing movements and the longitudinal movements of the sides of the horse's body.

18. A flexible harness saddle tree as defined in claim 17, with the tree having a flexible strip arranged on each of its opposed surfaces to encase the tree to form a harness saddle upper band shaped to encircle a horses back and sides rearwardly of the horse's neck.

19. A flexible harness saddle tree as defined in claim 17, and said bight portion of the band being narrower, in the transverse direction, than the legs.

* * * * *